United States Patent [19]

Burgio, Jr.

[11] Patent Number: 4,864,145

[45] Date of Patent: Sep. 5, 1989

[54] APPARATUS AND METHOD FOR CURING PHOTOSENSITIVE COATINGS

[76] Inventor: Joseph T. Burgio, Jr., 725 Jennings St., Bethlehem, Pa. 18017

[21] Appl. No.: 925,594

[22] Filed: Oct. 31, 1986

[51] Int. Cl.[4] ..... B05D 3/06

[52] U.S. Cl. ..... 250/492.1; 250/493.1; 250/504 R

[58] Field of Search ..... 250/492.1, 492.2, 492.3, 250/493.1, 492.23, 492.24, 491.1, 504 R

[56] References Cited

U.S. PATENT DOCUMENTS

| | | | |
|---|---|---|---|
| 2,380,682 | 7/1945 | Boerstler | 88/107 |
| 3,159,464 | 12/1964 | Early et al. | 34/4 |
| 3,766,377 | 10/1973 | Junginer | 240/41.5 |
| 3,831,289 | 8/1971 | Knight | 34/4 |
| 3,894,343 | 7/1975 | Pray et al. | 34/4 |
| 3,950,650 | 4/1976 | Pray et al. | 250/504 |
| 4,000,407 | 12/1976 | Keller | 240/47 |
| 4,019,062 | 4/1977 | Rongren | 250/492.1 |
| 4,048,490 | 9/1977 | Troue | 240/41.35 |
| 4,220,865 | 9/1980 | Silverman | 250/504 |
| 4,222,177 | 9/1980 | Mason | 34/4 |
| 4,563,589 | 1/1986 | Scheffer | 250/504 |
| 4,644,899 | 2/1987 | Glaus | 427/54.1 |

FOREIGN PATENT DOCUMENTS

| | | | |
|---|---|---|---|
| 221133 | 12/1983 | Japan | 250/492.1 |
| 147608 | 9/1984 | Japan | 250/492.1 |

*Primary Examiner*—Carolyn E. Fields
*Assistant Examiner*—John A. Miller
*Attorney, Agent, or Firm*—Joseph J. O'Keefe

[57] ABSTRACT

A method and apparatus for curing a photosensitive coating on a moving substrate.

A method for curing a photosensitive coating on a moving substrate by exposing the coating to a beam of light emitted from a high intensity light source. The substrate is substantially shielded from direct rays of light from such light source and the beam of light is reflected and focused in a broadening path, initially generally parallel to and spaced from the substrate, filtered and caused to strike a reflective surface that subsequently reflects and redirects the broadening beam of light to impinge in a band upon the photosensitive coating to cure it as it passes on the moving substrate.

Apparatus for curing a photosensitive coating on a moving substrate comprising a high intensity light source, which is substantially shielded to prevent its direct rays from striking the photosensitive coating; a first reflector, which partially surrounds the light source to focus a portion of the light therefrom in a broadening beam generally parallel to the moving substrate; a transaprent coolant-filter, which is located on the opposite side of the light source from the first reflector, for filtering the broadening beam from the light source; a second reflector, which is on the opposite side of the filter from the light source, to receive the focused and filtered broadening light beam and redirect it at an angle to impinge in a band on the photosensitive coating to cure it as it passes beneath the apparatus on the moving substrate.

13 Claims, 4 Drawing Sheets

1
2
3
4
10
11
12
13
14
15
16
17
18
19
20
30
40
42
43
44
47
50
51
53
55
57
59
62
64
70
71
72
75
80
85
86
90
100
103
104
110
113
W 56
90
48
26
58
60
1
16
11
65
63
46
44
54
88
4
4
100
41
42
72
L
61
70
50
113
51
62
40
53
3
3
87
43
45
14
64
57
17
59
19
15
30
25
89
47
55

13
12
10
26
1
101
11
48
90
23
42
105
22
40
56
21
100
61
50
14
70
θ
120
41
52
103
104
46
60
14
113
20
19
102
17
30
111
18
110
112
d
4
3
2

103
113
2
120
7
B''
C''
110
B
C
Δ
W'
α
θ
A'
A
A''
B'
C''
d
70
85
86
3
52
50
35
4
42
30
40
46
17

70
73
75
76
85
77
79
90
72
78
71
83
74
80
81
86
82
84

APPARATUS AND METHOD FOR CURING PHOTOSENSITIVE COATINGS

BACKGROUND OF THE INVENTION

This invention relates to apparatus and a method for curing photosensitive coatings. More particularly it relates to apparatus and a method that utilize a high intensity light source to create a beam of light that is reflected and focused, filtered and redirected to cause the ultraviolet rays emitted by the light to impinge on a photosensitive coating on a moving substrate in a manner to cure the coating, while avoiding damage to the substrate due to undesirable heat rays from the light.

The mechanisms of ultraviolet curing for photosensitive coatings are well known and understood. The emitter of ultraviolet light most commonly used is a medium pressure mercury vapor lamp, which provides a broad band of power in the 250–400 nm. range. The lamp may be doped by the addition of certain metal halides or other substances in order to provide a relatively higher spectral output at certain frequencies. The majority of such lamps in commercial use today fall within the 100–300 watt per linear inch power rating. It is well known that as the lamp wattage per inch increases in medium pressure lamps the total proportion of ultraviolet rays to total radiant output increases, although there is a tendency for the spectral output to shift to higher wavelengths. As a result of this phenomenon, care must be taken in selecting lamp output, as there will necessarily be a trade off between increasing lamp power, which will effect a greater cure rate, and sacrificing shorter wavelengths, as this will result, in some cases, in reduced top surface cure. The manner or degree of curing of photosensitive coatings by ultraviolet light is a function of several factors, including the specific photo initiator used and its extinction coefficient at a particular wavelength.

The removal of non-ultraviolet radiated and/or heat energy in the associated heating of a substrate in the curing process for photosensitive coatings and problems related thereto have been approached and resolved in many different fashions.

U.S. Pat. No. 3,950,650 to Robert W. Pray et al. and U.S. Pat. No. 4,563,589 to H. D. Scheffer et al. disclose the use of air cooling for ultraviolet curing lamp systems.

U.S. Pat. No. 3,766,377 to K. Junginger et al. discloses an incandescent spotlight system that includes an incandescent lamp, a reflector disk, heat filter, cover plate which seals the light aperture, a Fresnel lens which refracts the light rays to form a parallel beam, and a non-explosive pressurized gaseous coolant system.

Various arrangements have been proposed and utilized to rotate lamp assemblies so as to direct light away from a substrate or to interpose a shutter device between a lamp and a substrate under certain conditions to avoid overheating of the substrate. Such arrangements are shown in U.S. Pat. No. 3,831,289 to R. Knight, U.S. Pat. No. 3,894,343 to R. W. Pray, et al. and U.S. Pat. No. 4,220,865 to S. Silverman.

In similar fashion various arrangements have been proposed and utilized for liquid cooling of apparatus for applying radiant energy. For example, U.S. Pat. No. 2,380,682 to E. W. Boerstler discloses the use of a water cooler around an incandescent lamp and the use of both a liquid filter and a solid filter for the purpose of filtering long wave infrared rays. U.S. Pat. No. 4,000,407 to C. H. Keller and U.S. Pat. No. 4,221,177 to R. M. Mason each discloses a water system associated with a mercury vapor lamp for filtering and cooling purposes.

Another arrangement for delivering relatively cold ultraviolet light to a substrate is shown in U.S. Pat. No. 4,048,490 to H. H. Troue. In this patent dichroic filters are used to absorb undesired infrared light in a high intensity light-source system and direct relatively cold ultraviolet light on a substrate having a coating to be cured.

Still another arrangement that makes use of intense radiant energy to dry printed sheets is disclosed in U.S. Pat. No. 3,159,464 to H. C. Early et al., wherein a high pressure, mercury arc lamp or carbon arcs are used as a source of radiant energy. The radiant energy is of high intensity having a wavelength predominantly within a particular range, and the intensity of the radiation must exceed, for example, one kilowatt per square inch of printed surface.

SUMMARY OF THE INVENTION

In commercial and industrial applications it has become apparent that until now, despite the rhetoric in the descriptions of the aforementioned patents, none of the solutions presented for dealing with the difficulties of high intensity light sources for curing photosensitive coatings have been successful. They have been unable to overcome the practicalities of being mounted in certain types of machines and the problems of prolonged high output exposure of coating substrates, without the damage associated with the heating effect of ultraviolet lamps. Specifically, with respect to the application of multiple coatings to certain substrates, particularly paper and plastic substrates, the problems associated with overheating contribute to the rejection of an undesirable percentage of final products. Obviously, the rate of rejection increases the cost of printing or coating various commercial products. In addition, certain air cooling systems for ultraviolet light sources contribute to the formation of large amounts of ozone. From an environmental viewpoint, the formation of large amounts of ozone in any working environment is unacceptable. Furthermore, such air cooling systems frequently contribute to vapor depositions on the various elements, which lead to inefficient operation.

The above and other disadvantages are overcome by the present invention, which teaches the use of a source of relatively higher than normal radiation output coupled with reflectors and a coolant filter, all mounted in a smaller physical package than ultraviolet light curing systems presently in use. More important, the method and apparatus of this invention result in a significantly lower heat gradient at the target than presently used ultraviolet light curing systems, and the apparatus is more economical to operate than such present systems.

One clear distinction to be made concerning the present invention is the effect of all radiation emitted by the lamp on the target area. All radiation produced by the lamp will create a heating effect where absorbed by the target. Because of this effect, there can be no clear distinction between the heating effects of different band widths of radiation, including infrared, visible, and ultraviolet. The relative effectiveness of heating at a target or coating subsurface is determined not just by specific wavelengths, but rather the relative absorbtion characteristics of the materials at the target. Thus, certain filtering devices can only be effective in reducing heating at a target depending upon the absorption bandwidth and efficiency at which they work and the amount of non-useful energy the filters absorb as a percentage of all non-useful energy emitted by the source. The theory of this invention is that both the direct and indirect radiation from the lamp source must be treated in the same manner enroute to the target.

Accordingly, it is an object of this invention to provide a method for reflecting and focusing, filtering and redirecting a beam of light from a high intensity light source to impinge on a photosensitive coating on a moving substrate, substantially shielded from direct rays of light from the light source, to cure such coating without causing distortion or damage to the substrate due to heat.

It is another object of this invention to provide apparatus for reflecting and focusing, filtering and redirecting light from a high intensity light source upon a photosensitive coating on a moving substrate, substantially shielded from direct rays of light from the light source, to cure such coating without causing distortion or damage to the substrate due to heat.

It is a further object of this invention to provide such apparatus in a compact modular form suitable for installation in cramped locations in commercially available printing and coating equipment.

It is a further object of this invention to provide such apparatus in a compact modular form such that a plurality of such modules can be assembled side by side to cure the coating on any width substrate.

It is a final object of this invention to provide such apparatus which minimizes the formation of ozone, retards the deposition of vapors on the various elements of the apparatus, is easy to maintain and efficient to operate.

The invention may be described broadly as:

A method for curing photosensitive coatings on a moving substrate. The method comprises exposing a photosensitive coating on a moving substrate to a beam of light generated by a high intensity light source. The substrate is substantially shielded from direct rays of light from the source, and the beam of light is reflected and focused in a path, initially generally parallel to and spaced from the substrate, filtered and caused to strike a reflective surface that subsequently reflects and redirects the beam of light to impinge in a band upon the photo-sensitive-coating, to cure it as it is conveyed on the moving substrate.

Apparatus for curing a photosensitive coating on a moving substrate that comprises a high intensity light source, which is substantially shielded to prevent its direct rays from striking the substrate coating; an arcuate first reflector, which partially surrounds the light source to focus a portion of the light therefrom in a beam initially generally parallel to the moving substrate; a transparent coolant-filter, which is located on the opposite side of the light source from the arcuate reflector for filtering the beam of light from the light source; a generally flat second reflector, which is on the opposite side of the filter from the light source to receive the focused and filtered light beam and redirect it at an angle to impinge in a broad band on the photosensitive coating to cure it as it passes beneath the apparatus on the moving substrate. The apparatus further comprises a housing that encompasses the light source, arcuate first reflector, transparent filter and generally flat second reflector. The housing is adjacent and spaced from the moving substrate. It includes a bottom opening or window through which the filtered beam of light, which strikes the flat second reflector and is reflected and redirected therefrom, passes in a band and impinges on the photosensitive coating on the moving substrate.

BRIEF DESCRIPTION OF THE DRAWINGS

The nature of the invention will be more clearly understood by reference to the following description, the appended claims and the several views illustrated in the accompanying drawing.

DESCRIPTION OF THE PREFERRED EMBODIMENT

Figure 1:
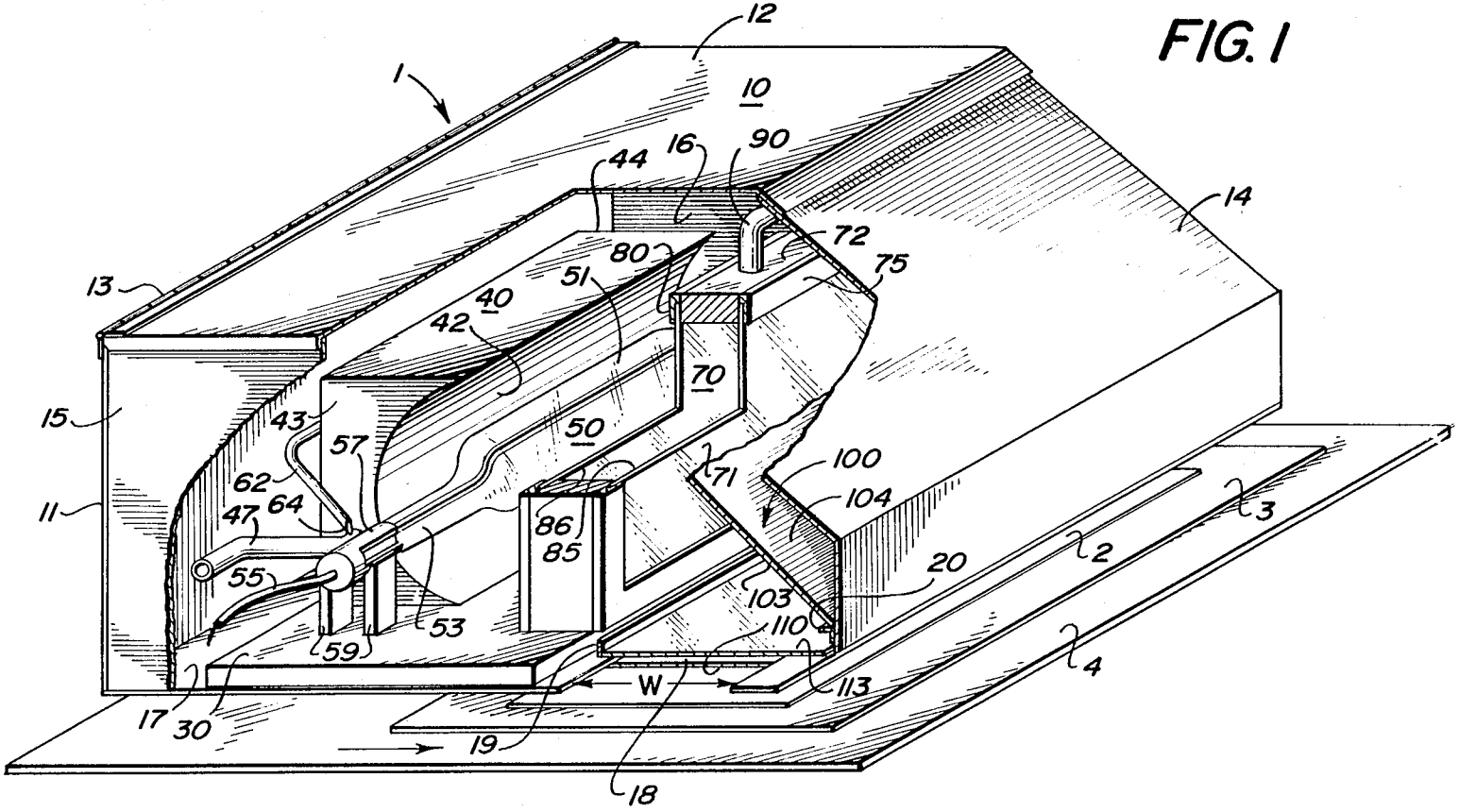
FIG. 1 is an oblique diagrammatic view, with portions broken away and in section, of apparatus of the present invention.
Figure 2:
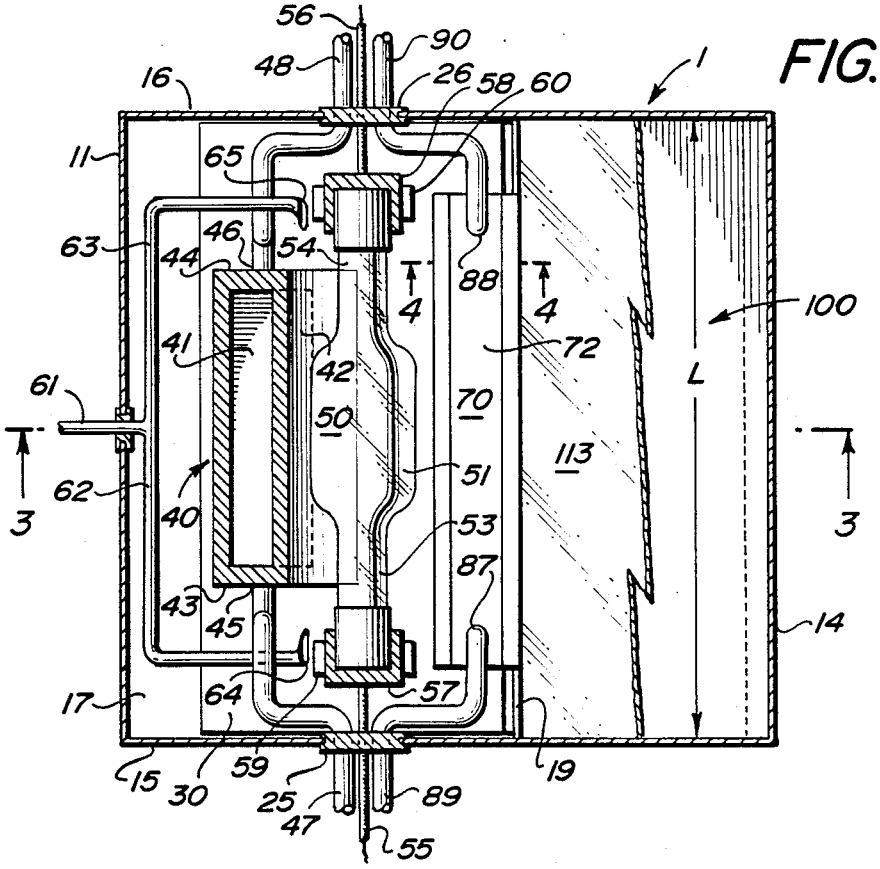
FIG. 2 is a schematic top view, partially in section, of the apparatus of FIG. 1.
Figure 3:
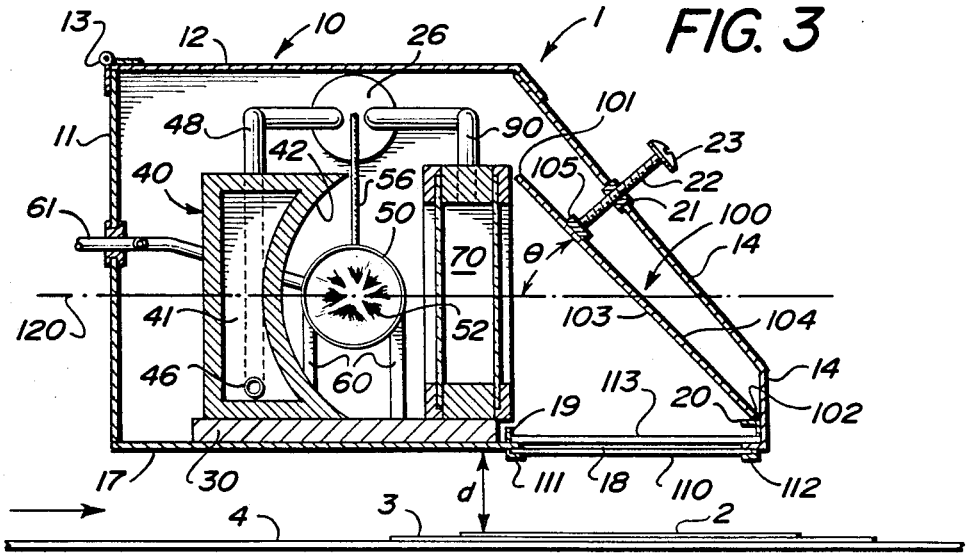
FIG. 3 is a transverse cross-sectional view of the apparatus of FIG. 2 taken along the line 3—3.

Referring to FIGS. 1–3, there is shown apparatus 1 for curing or drying a photosensitive coating, such as ink 2, which has been applied by printing or coating on a substrate 3 placed on a moving belt 4 that passes beneath apparatus 1, at a distance d therefrom, in the direction shown by the arrow.

Apparatus 1 includes a housing 10, generally rectangular in shape, that extends transversely of belt 4 that passes below housing 10. Housing 10 has a back plate 11, top plate 12, that is fastened by hinge 13 to back plate 11, angled front plate 14, side plates 15 and 16, and bottom plate 17 that is generally parallel to belt 4. In bottom plate 17, adjacent the lower end of front plate 14 is a transversely extending opening 18. Opening 18 has a width W and a length L. Extending upwardly from bottom plate 17 is bracket 19 that is spaced from and parallel to opening 18. On the inner side of front plate 14, adjacent bottom plate 11, is support angle 20. As shown in FIG. 3, angled front plate 14 has a hole therein in which is mounted threaded nut 21. Extending through nut 21 is a threaded adjusting shaft 22 having a head 23. As shown best in FIG. 2, housing side plates 15 and 16 have ports 25 and 26, respectively, for purposes hereafter described.

As best shown in FIGS. 1 and 3, a base plate 30 is secured to and extends transversely of bottom plate 17, from side plate 15 to side plate 16, and is spaced from opening 18 therein. As best shown in FIGS. 2 and 3, mounted on bottom plate 17 is an elongated reflector 40 having a hollow interior 41, a front aspheric trough, i.e. concave in cross section, reflective surface 42 and sides 43 and 44. Side 43 has inlet connection 45 and side 44 has outlet connection 46, which are connected to inlet tubing 47 and outlet tubing 48, respectively, by means of which a liquid coolant from a source, not shown, is circulated through the hollow interior 41 of reflector 40.

As shown in FIGS. 1–3, an elongated medium pressure, mercury vapor lamp 50, i.e. a line source of light, is mounted on base plate 30 and extends transversely thereof. As is known to those skilled in the art a medium pressure, mercury vapor lamp is one that operates at an internal pressure of between 2 and 4 atmospheres at its operating temperature. Lamp 50, spaced from, and extending parallel to, the front center of reflector surface 42, has a central portion 51, wherein there is formed an arc 52 that emits radiation, and end portions 53 and 54. Arc 52 is formed in the space between wires 55 and 56 within lamp central portion 51. The wires 55 and 56 extend through lamp end portions 53 and 54, respectively, and are connected to a suitable power source, not shown, for energizing lamp 50. Lamp end portions 53 and 54 are mounted in refractory insulators 57 and 58, respectively, which are held in position by mounting brackets 59 and 60, respectively, that extend upwardly from base plate 30.

As best shown in FIG. 2, air tube 61 passes through back plate 11 of housing 10, divides into branches 62 and 63 having flared open ends 64 and 65, respectively, that are located adjacent lamp end portions 53 and 54, respectively. Low volume compressed air from a source, not shown, passes through tube 61, branches 62 and 63 and out of their ends 64 and 65, respectively, and is directed at lamp end portions 53 and 54 and insulators 57 and 58 to cool those portions of lamp 50 without channeling any such air directly across the central portion 51 of lamp 50.

Figure 4:
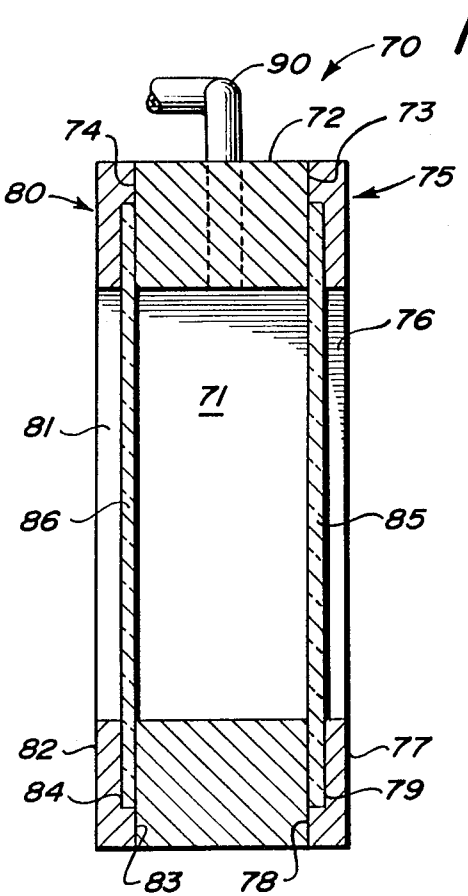
FIG. 4 is an enlarged cross-sectional view of a portion of the apparatus of FIG. 2, taken along the line 4—4, showing the construction thereof in greater detail.

As best shown in FIGS. 1 and 3, extending upwardly from the forward end of base plate 30 is filtering compartment 70, which extends transversely of housing 10, is parallel to, and spaced from, lamp 50 and on the opposite side thereof from reflector 40. As shown in FIG. 4, compartment 70 has a hollow body portion 71, with a top portion 72, a front face 73 and a back face 74. A front cover frame 75 having an open central portion 76, outer face 77 and inner face 78, with recessed portion 79 machined therein, is secured to hollow body portion 71 in any suitable manner, as by screws or bolts. The front face 73 of hollow body portion 71 is adjacent the inner face 78 of front cover frame 75. A back cover frame 80 having an open central portion 81, outer face 82 and inner face 83, with recessed portion 84 machined therein, is secured to hollow body portion 71 in any suitable manner, as by screws or bolts. The back face 74 of hollow body portion 71 is adjacent the inner face 83 of back cover frame 80. A front ultraviolet transmissive pane 85, resistant to high temperatures, fits into recess portion 79 of front cover frame 75 and is held firmly against body portion front face 73 by means of front cover frame 75. A back ultraviolet transmissive pane 86, resistant to high temperatures, fits into recessed portion 84 of back cover frame 80 and is held firmly against body portion back face 74 by means of back cover frame 80. Thus, hollow body portion 71 of compartment 70 is closed across its front face 73 and back face 74 by means of panes 85 and 86, respectively.

As best shown in FIG. 2, compartment top 72 is fitted with an inlet connection 87 and an outlet connection 88. An inlet tube 89 connects at one end to inlet connection 87 and extends to a source of liquid coolant-filtrant, not shown. An outlet tube 90 connects at one end to outlet connection 88 and extends to a reservoir, not shown, where the coolant-filtrant can be treated and recycled. Coolant-filtrant inlet tubing 47 to reflector 40 and coolant-filtrant inlet tube 89 to compartment 70, along with wire 55 to lamp 50 pass from housing 10 through port 25 in side plate 15. Coolant-filtrant outlet tubing 48 from reflector 40 and coolant- filtrant outlet tube 90 from compartment 70, along with wire 56 to lamp 50 pass from housing 10 through port 26 in side plate 16.

As best shown in FIGS. 1 and 3, a tilting reflector 100 is positioned at an angle forward of filter compartment 70. Tilting reflector 100 has a top edge 101, bottom edge 102, a generally flat front reflective surface 103 and a back surface 104. On tilting reflector back surface 104 is a swivel 105 that connects with the lower end of threaded shaft 22 and permits it to turn freely while connected to the reflector 100. Tilting reflector bottom edge 102 rests upon and pivots about support flange 20 on the inner face of front plate 14. As shown in FIG. 3, the horizontal centerlines of reflector 40, lamp 50, filter compartment 70 and tilting reflector 100 lie generally in the same horizontal plane indicated by the hypothetical line 120. Tilting reflector 100 is at an angle $\theta$, preferably 45 degrees, to such plane line 120. The position of tilting reflector 100 may be adjusted by means of threaded shaft 22 to move top edge 101 toward or away from the top of compartment 70, which will change the angle $\theta$ between tilting reflector 100 and plane line 120.

Bottom ultraviolet transparent pane 110 extends across the bottom of opening 18 of bottom plate 17. Pane 110, like opening 18, extends transversely of housing 10 from side plate 15 to side plate 16. Pane 10 is slightly wider than opening 18 and firmly held in place beneath it by means of brackets 111 and 112 that are parallel to, and spaced from, the lateral edges of opening 18. Top pane 113, which is made of material that is ultraviolet transmissive and is opaque to radiation outside of its spectrum, extends over the top of bottom plate opening 18 and, like it, extends from housing side plate 15 to housing side plate 16. Pane 113 is slightly wider than opening 18 and held in place between bracket 19 and the bottom inner face of front plate 14, both of which are spaced from and parallel to the lateral edges of opening 18.

Figure 5:
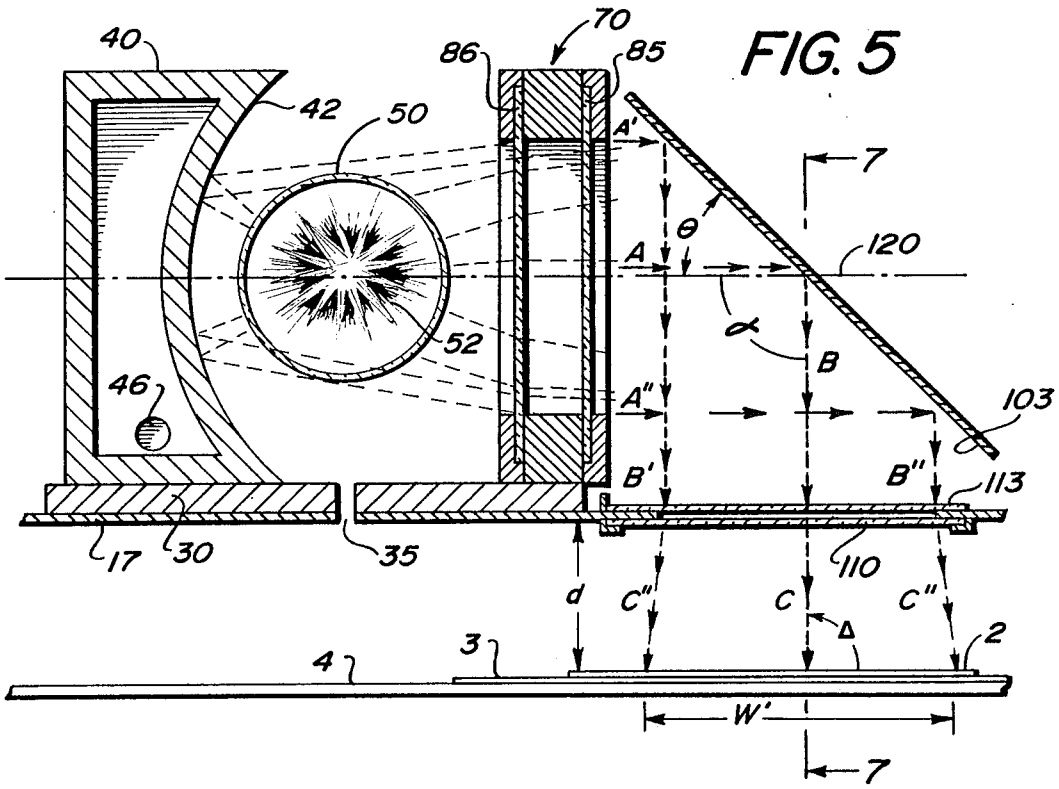
FIG. 5 shows schematically the arrangement of a portion of FIG. 3 illustrating schematically the path of the beam of ultraviolet rays that are reflected and focused, filtered and reflected and redirected by the apparatus of this invention.

As illustrated schematically in the left portion of FIG. 5, light rays emitted from the filter compartment side of lamp 50, shown by dotted lines, pass directly to filter compartment 70. Light rays emitted from the reflector side of lamp 50, shown by broken lines, pass to reflector surface 42 from which they are reflected and focused to pass indirectly to filter compartment 70. The indirect and direct rays collectively form a light beam. A plane through the horizontal center of such beam coincides with the horizontal plane 120 on which lie the horizontal centerline of reflector 40, lamp 50, filter compartment 70, and tilting reflector 100. The light beam, which initially comprises desirable ultraviolet rays, undesirable infrared rays and rays of visible light that provide undesirable heat, passes through filter compartment 70. That is, the light beam passes through open central portion 81 of back cover frame 80, back pane 86, the coolant-filtrant circulating through filter body portion 71, front pane 85 and open central portion 76 of front cover frame 75. The rays of the light beam are slightly refracted in passing through the cooling-filtrant in compartment 70. The major portion of undesirable infrared light rays are filtered out, a portion of the heat containing visible light rays are eliminated, and the desirable ultraviolet light rays pass through.

For ease of explanation hereafter, the rays of the light beam will be described collectively as a single beam rather than a plurality of beams, each acting in an individual manner. As shown in the right portion of FIG. 5, after passing through compartment 70, the light beam, identified by solid arrows A at the beam's center, A' at the beam's top extremity and A" at the beam's bottom extremity, strikes the generally flat front reflective surface 103 of tilting reflector 100. The center of the light beam lies in the same horizontal plane, i.e. in the plane of hypothetical centerline 120, as the centerline of reflector 40, lamp 50 and filter compartment 70. Thus, the center of the light beam strikes reflective surface 103 at an angle $\theta$, preferably about 45 degrees, to tilting reflector 100. The light beam is reflected and redirected from reflective surfaces 103 at an angle $\alpha$, preferably about 90 degrees to hypothetical center line 120, as shown by broken line arrows B at the beam's center, B' at the beam's left extremity and B" at the beam's right extremity. The major portion of the light beam then passes through housing opening top pane 113, housing opening 18, housing opening bottom pane 110 and out of housing 10.

Figure 7:
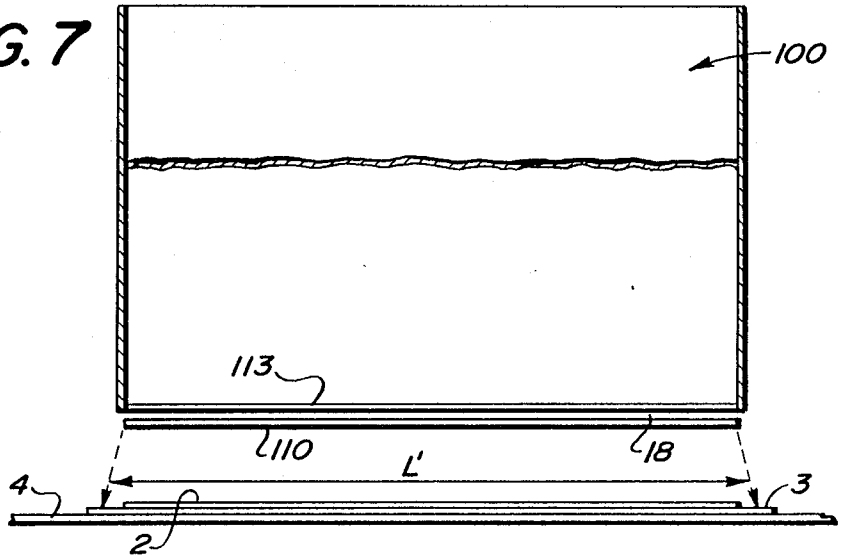
FIG. 7 is a cross sectional view of FIG. 5, taken along the line 7—7, illustrating generally the manner in which the band of ultraviolet rays are reflected from a portion of the apparatus of this invention to impinge upon the photosensitive coating and substrate.

As shown in FIG. 5, the light beam passes through the distance d, between the bottom plate 17 of housing 10 and the top surface of coating 2, and impinges upon the top surface of coating 2. After leaving housing 10, the light beam widens slightly as shown by dotted line arrows C at the beam's center, C' at the beam's left extremity and C" at the beam's right extremity. The light beam impinges, preferably perpendicularly, upon coating surface 2, shown at an angle $\Delta$ of 90 degree to centerline C. The light beam impinges in a band, having a width W' and length L', as shown in FIG. 7, slightly wider than width W and longer than length L of opening 18. The size of the band of impingement is a function of the distance d between housing bottom plate 17 and the surface of substrate coating 2. The impingement of the light beam on the surface of coating 2 cures it as it passes beneath housing opening 18.

As illustrated in FIGS. 1–3, the major components of apparatus 1 of this invention are enclosed in housing 10. Housing 10, base plate 30, reflector 40 and filter compartment 70 are made of aluminum. They absorb heat and act as heat sinks for the heat generated by lamp 50 during operation. Base plate 30 forms a support for reflector 40, lamp 50 and filter compartment 70, each of which is fastened to the base plate in a manner known to those skilled in the art. Equally as important, base plate 40 and housing bottom 17 act as a shield to prevent in the preferred embodiment of this invention, all direct rays of light from lamp 50 from passing directly to substrate 3 on belt 4 that moves parallel to hypothetical plane center line 120.

Obviously, all of the light emitted from lamp 50 does not pass through filter compartment 70. Stray light rays, some partially from the top and bottom filter compartment side portions of lamp 50, strike base 30, sides 15 and 16 or top plate 12 of housing 10 and are reflected about housing 10. In similar fashion, not all the light rays that pass through filter compartment 70 or that strike front surface 103 of tilting reflector 100 are redirected through opening 18 to coating 2 on substrate 3. A portion of rays of the light beam stray and are reflected about housing 10. The portion of such latter stray rays that reflect about housing 10 is a function of the width W and length L of housing bottom opening 18 as shown in FIGS. 1 and 2 respectively. The stray light rays that are reflected about housing 10 contribute to the operating temperature of apparatus 1.

In the preferred embodiment of the invention described above, lamp 50 is a medium pressure mercury vapor lamp of 3000 watts and the distance between the electrodes of the lamp is 2 inches. Thus, the output of the lamp is 1500 watts per inch. As known to those skilled in the art, such lamps are rated in this linear manner. The 1500 watts per inch lamp of this invention is substantially greater than the number of watts per inch of other mercury vapor lamps presently used to cure photosensitive materials. Reflector 40 has a height of 4 inches and a length, transversly of housing 10, of 4.5 inches. Open central portion 76 of front cover frame 75 and open central portion 81 of back cover frame 80 of filter compartment 70 have openings 2.5 inches high and 5.5 inches in length transversely of housing 10. Tilting reflector 100 has a width of 3.5 inches and a length of 8 inches, transversely of housing 10. Housing 10 is 5 inches high, 8 inches wide and 8 inches in length, and its bottom opening 18 is 2 inches wide and 8 inches in length transversely of housing 10.

Figure 6:
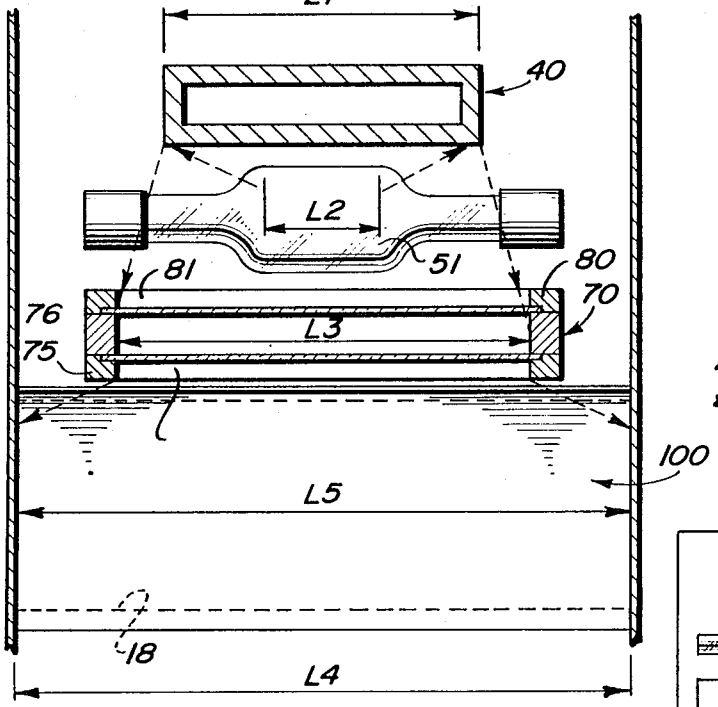
FIG. 6 is a top schematic view of the major elements of this invention illustrating their relative lengths and the manner in which the beam of light rays widens as it passes through the apparatus of the invention.

As shown in FIG. 6, the comparative lengths of the main elements of the invention are illustrated. Reflector 40 has a length Ll equal to 4.5 inches, lamp central portion 51 has a length L2, i.e. the arc distance, equal to 2 inches, the open frame portions of filter compartment 70 have a length L3 equal to 5.5 inches, tilting reflector 100 has a length L4 equal to 8 inches and housing bottom opening 18, shown in phantom, has a length L also equal to 8 inches. As shown schematically the extreme rays emitted over the arc length L2 of lamp central portion 51 strike reflector surface 42 of reflector 40 along its full length L1. They are reflected and focused in a band that broadens as it passes to and through the open central portions 81 and 76, having a length L3, of cover frames 80 and 75, respectively, of filter compartment 70. The light beam continues to broaden as it passes to and strikes tilting reflector 100 across its transverse length L4, equal to length L of opening 18. As shown in FIG. 7, the light beam reflects and is redirected to pass through pane 113, bottom opening 18, having a width W and length L, and pane 110, and further broadens to impinge in a band having a length L' across the surface of coating 2 on substrate 3. The length L' of the beam's band of impingement upon coating 2 is at least equal to and in most instances slightly greater than L, the length of bottom opening 18. The length L' of the band is dependent upon the distance d between the bottom plate 17 of housing 10 and the top surface of coating 2 on substrate 3. The greater the distance d, the more opportunity the light band has to spread.

Thus, in the preferred embodiment, the length L4, i.e. 8 inches, of tilting reflector is four times as long as lamp central portion 51, length L2, i.e. two inches. Since, lamp 50 has a 3000 watt power rating, i.e. 1500 watts per linear inch, the radiation striking reflector 100 having a length of 8 inches has an intensity of 3000 watts or 375 watts per linear inch. The redirected light beam from reflector 100 impinges in a slightly broader band upon coating 2 of substrate 3 with slightly diminished intensity, about 350 watts per linear inch.

In the preferred embodiment of this invention described above, reflective surface 42 of reflector 40 is coated with an enhanced surface material, well known to those skilled in the art and machined to a high surface tolerance. Surface 42 is ellipsoidal and has two focal points, one at the center of lamp 50 and one at the center of reflective surface 103 of reflector 100, i.e. at the intersection of line 120 with reflective surface 103. Liquid coolant at a temperature of between 50 degrees F. to 100 degrees F. is circulated through reflector hollow interior 41 at a flow rate of about 0.667 gallons per minute so that the outlet temperature is kept under about 130 degrees Fahrenheit. Lamp 50 is made of quartz and the interior surface is doped with a metal halide, which doubles the output of 366 nm rays with the same total frequency, to help subsurface curing of coating 2. Lamp 50 has an internal pressure of 2 to 4 atmospheres and an operating temperature of about 1100 degrees Fahrenheit.

Compressed air from a source, not shown, is fed through air tube 61 to the flared branch ends 64 and 65 and directed against lamp ends 53 and 54 and insulators 57 and 58, respectively. The compressed air keeps the end portions cool without bathing the surface of lamp 50 to reduce its temperature and, in the process, create objectionable ozone. The compressed air, at a flow rate of about 2 cubic feet per minute, creates a slight positive pressure within housing 10 and exits therefrom through the clearance in housing side part 25 around reflector inlet tubing 47, filter compartment inlet tube 89, and lamp wire 55, and housing side port 16 around reflector inlet tubing 48, filter compartment outlet tube 90 and lamp wire 56. The positive air pressure within housing 10 acts to improve operations in several ways. It retards the infiltration of housing 10 by mists of inks, oils, and varnishes normally associated with the printing or coating operations. It also prevents offset powders, which may be electrostatically charged and which are used many times when ultraviolet curing equipment is out of operation, from collecting on lamp 50 or on the equipment surfaces, particularly reflective surface 42 and tilting reflector front surface 103, and decreasing their efficiency.

In the preferred embodiment of the invention described above, no direct radiation from lamp 50 is permitted to impinge upon the surface of coating 2 on substrate 3 that passes a short distance beneath housing 10 on moving belt 4. As shown in FIG. 5, the centerline, i.e. 120, of the hypothetical plane passing through the center of reflector 40, lamp 50, and compartment 70 is parallel to the path of movement of belt 4. Thus the beam of light created by lamp 50 and focused by reflector 40 is initially directed generally parallel to belt 40 carrying subsurface 3, having coating 2 thereon, and the belt is initially shielded from direct radiation from lamp 50 by base plate 30 and housing bottom plate 17.

When curing certain types of coatings or inks it may be desirable to preheat such coatings or inks for most efficient curing. The method and apparatus of this invention can be modified to permit such preheating by including, as shown in FIG. 5, a narrow opening 35 through base plate 30 and housing plate 17. Bottom opening 35 is as wide and as long as is required to permit whatever degree of direct radiation is required from lamp 50 to impart to coating 2 whatever degree of preheating is required to have the radiation subsequently passing through opening 18 thoroughly cure coating 2. Opening 35 is either omitted from the apparatus or, when required sized to permit between 2 percent and ten percent of direct rays from lamp 58 to pass through the preheat coating 2.

In the embodiment of the invention described above the beam of light emitted from lamp 50 and reflected and focused by reflector surface 42 travels initially in a direction coincidental with the plane indicated by line 120 and generally parallel to the plane of moving belt 4. For various operations, and to accommodate the placement of apparatus of this invention in certain coating or printing machines, it may be desirable to tilt apparatus 1 so that centerline 120 is at an angle of between 170 and 190 degrees to the plane of moving belt 4. This will obviously change the angle at which the light beam passing through opening 18 impinges upon the surface of coating 2 and subsurface 3. While the preferred angle of impingement is 90 degrees, effective curing can be obtained by having the angle of impingement between 80 degrees and 100 degrees. It is also possible to maintain apparatus 1 in a position having centerline 120 parallel to the plane of moving belt 4 and adjust tilting reflector 100 so that angle $\theta$ is changed from the preferred 45 degrees, to an angle between 40 degrees and 50 degrees in order to accommodate certain operations.

Other modifications may be made to the preferred method and apparatus described above, depending upon the configuration of subsurface 3 and the nature and chemical composition of coating 2. For example, the length L and width W of opening 18 can be modified to enlarge or decrease the size of the band of impingement on the surface of coating 2. Coating 2, shown in the Figures applied to a flat subsurface 3, can also be applied to a subsurface 3 having a round or curved surface. When apparatus 1 is used for curing the surface of a coating applied to a round or curved surface, centerline 120 of certain elements of the apparatus is generally parallel to a line drawn tangent to the circular or curved surface. The light beam of such apparatus is initially directed generally parallel to such tangent and subsequently reflected and redirected to impinge upon the coating on such surface at an angle between 80 degrees to 100 degrees of such tangent, and preferably about 90 degrees thereto.

The apparatus may also be modified to have the housing altered to have opening 18 on the top and tilting reflector 100 repositioned to redirect the light beam and cause it to impinge on a coating on a substrate on a belt moving above the housing. For example, the curing of printing on certain types of boxes and cartons is accomplished in this manner. The apparatus may be further modified to remove bottom opening pane 113 if the function of the pane, i.e. to further filter certain radiation from the light beam is not required for curing a particular coating 2 that is being used. And, for certain purposes, it also may be desirable to remove bottom opening bottom pane 110.

Figure 8:
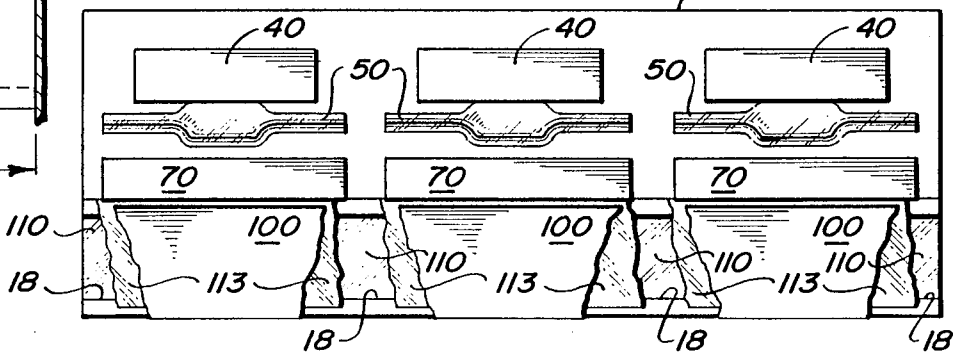
FIG. 8 is a top schematic view illustrating the manner in which the major elements of several modules of this invention may be assembled.

In FIG. 8 the main elements of three apparatus of the invention are shown assembled side by side in one enlarged housing 10'. There are shown three reflectors 40, three lamps 50, and three filter compartments 70. There are also three tilting reflectors 100, three housing opening top transparent panes 113 and three housing opening bottom transparent panes 110 because of the difficulty inherent in obtaining such parts of sufficient length to span a single bottom opening three times the length of the usual opening. Each of the elements function in similar manner to that described above, except that the bottom opening 18 extends for the full length of the housing 10'. Thus, there are no gaps in the manner in which the three separate beams of light impinge on a coating passed beneath the three modular housings. In fact, because each light band widens somewhat, as it passes through the opening 18, as shown in FIGS. 5 and 8, there is a small area of overlap of the edges of center light beam impingement band with the edge of abutting portions of the other two impinging light bands.

The apparatus of this invention yields a compact assembly, fully protected from the exterior environment and yet more open within its confines than other units presently used for ultraviolet curing purposes. The open area within a housing 10 allows lamp 50 to radiate more of its undesirable heat rays in a larger area. This feature contributes to source stability as the heating within the housing does not cause heating of a coating surface or comparable target area.

The preferred embodiment of the invention described above has accomplished curing equal to or better than that of presently available systems, without their undesirable heating. In an experiment conducted with the apparatus shown in FIG. 1, there was produced a heat gradient not more than 25 degrees F./min. on average at a target located 2 inches below housing 10. This was accomplished in open ambient atmospheric conditions with a static substrate and without any means of actively decreasing target temperature either by convected or conducted cooling means. In addition, prolonged exposure with fibrous materials yielded a maximum surface temperature of 270 degrees F. after 20 minutes of continuous full power exposure, at which time the heat energy equaled the fibrous substrates' natural ability to dissipate such heat, i.e. the target stabilized. Longer continued exposure resulted in no increase in exhibited substrate temperature.

Although reference has been made to lamp 50 having a 3000 watt power rating, i.e. 1500 watts per linear inch, it should be recognized that lamps generating radiation in the range of between 400 and 2000 watts per linear inch are suitable for use with the apparatus, and practicing the method of this invention. The result of that range of watts per linear inch is that the beam of light that impinges on coating surface 2 may have an intensity of between 100 and 500 watts per linear inch.

It is believed that several factors contribute to the successful use of the method and apparatus of this invention. The direct and indirect rays of light from lamp 50 are treated in the same manner before impingement on coating surface 2. That is, the direct and indirect rays of light are passed through a coolant-filtrant in compartment 70, they strike front reflective surface 103 of tilting reflector 100 and are reflected and redirected to impinge upon coating surface 2, all in the same manner. In addition, the length L of the impingement area on coating surface 2 and beyond it onto subsurface 3 as best shown in FIG. 7 is four times the length L2 of the central portion 51 of lamp 50 and, as mentioned above, since lamp 50 has a 1500 watts per inch power rating, the intensity of the light beam striking the impingement area is about 350 watts per linear inch. This intensity is substantially higher than that created by other line sources of ultraviolet light presently commercially available.

While this invention has been described with respect to several examples, modifications and variations can be made by those skilled in the art without departing from the spirit and scope of the invention as defined in the appended claims.

I claim:

1. Apparatus for curing a photosensitive coating on a substrate moving in a plane, comprising:

(A) A high intensity elongated medium pressure line light source means, having a central portion, for producing radiant energy rays comprising infrared light rays, heat containing visible light rays and ultraviolet light rays;

(b) first elongated reflector means, having a length greater than the length of the central portion of said light source means, adjacent said line light source means for reflecting and focusing a portion of the radiant energy rays to a first broadening beam of light in a first direction at an angle between about 170 degrees and 190 degrees of the plane of said substrate in the direction of movement;

(C) elongated cooler-filter means, having a length greater than the length of said first reflector means, adjacent said light source means, on the opposite side thereof from said first reflector means, for filtering infrared light rays and heat containing visible light rays from said first broadening beam of light and permitting said first broadening beam of light to continue broadening;

(D) generally flat second elongated reflector means having a length greater than the length of said cooler-filter means and adjacent thereto, on the opposite side thereof from said light source means, for receiving the first filtered broadening beam of light and reflecting and redirecting the main portion thereof in a second beam broadening in a second direction substantially transverse to the plane of said substrate in the direction of movement thereof to impinge upon and cure said photosensitive coating.

2. The apparatus of claim 1 further comprising plate means interposed between said light source means and said photosensitive coating to substantially shield said coating from direct radiant energy rays emitted by said light source means.

3. The apparatus of claim 1 wherein said light source means, first reflector means, filter means and second reflector means are enclosed in a housing comprising:

(A) a bottom plate means substantially shielding said photosensitive coating from direct radiant energy rays emitted by said light source means and having:

(1) an elongated transversely extending opening adjacent said second reflector means to permit the passage of the main portion of the second broadening beam of light reflected therefrom to impinge upon and cure said photosensitive coating.

4. The apparatus of claim 3 wherein first transparent pane means extends across said opening to seal said opening and prevent dirt from entering said housing.

5. The apparatus of claim 4 further including a second transparent pane means extending across said opening.

6. The apparatus of claim 1 wherein said light source means is a medium pressure mercury vapor lamp having a power rating between 400 and 2000 watts per inch.

7. The apparatus of claim 1 wherein said beam of light impinging upon said photosensitive coating has an intensity of between 100 and 400 watts per linear inch.

8. The apparatus of claim 1 wherein said second broadening beam of light impinges upon the photosensitive coating in a band having a length of between 1 and 8 times the length of the central portion of said line light source means.

9. A method of curing a photosensitive coating on a substrate moving in a plane, comprising the steps of:

(A) generating, from and elongated high intensity medium pressure, line light source means, having a central portion, radiant energy rays comprising infrared light rays, heat containing visible light rays and ultraviolet light rays;

(B) reflecting and focusing from a first elongated reflector means, having a length greater than the length of the central portion of said light source means, a portion of said radiant energy rays in a first broadening light beam in a first direction;

(C) passing said first broadening light beam through a coolant-filter, having a length than the length of said first reflector means, to filter a portion of said infrared light rays and heat containing visible light rays therefrom and permit said first broadening beam of light to continue broadening;

(D) passing the filtered first broadening light beam to a generally flat reflective surface means to reflect and redirect the filtered first light beam in a second broadening light beam in a second direction substantially transverse to the plane of said substrate in the direction of movement and cause a portion thereof to impinge upon and cure said photosensitive coating.

10. The method of claim 9 wherein said photosensitive coating is substantially shielded from direct radiant energy rays from said light source means.

11. The method of claim 10 wherein the first broadening light beam is focused in a first direction at an angle between 170 degrees and 190 degrees to the surface of said photosensitive coating in the direction of movement of said substrate.

12. The method of claim 10 wherein said first broadening light beam is reflected and redirected in a second direction and a portion thereof caused to impinge upon said photosensitive coating at an angle between 80 degrees and 100 degrees to the plane of said substrate in direction of movement thereof.

13. The method of claim 9 wherein the second broadening light beam reflected in a second direction is filtered before impinging upon said photosensitive coating.

* * * * *